United States Patent [19]

Holmes et al.

[11] Patent Number: 4,678,479

[45] Date of Patent: Jul. 7, 1987

[54] DIESEL FUEL COMPOSITION

[76] Inventors: Robert T. Holmes, 318 Hickory Post, Houston, Tex. 77079; Terence M. Evans, 8, Redhill Road, Kelsall, Tarporley, Cheshire CW6 0QP, United Kingdom; Keith King, 90, Green Lane, Vicars Cross, Chester, Cheshire CH3 5LE, United Kingdom; Leonard B. Graiff, Gatesheath Hall, Tattenhall, Chester, Cheshire CH3 9AH, United Kingdom

[21] Appl. No.: 850,658

[22] Filed: Apr. 11, 1986

[30] Foreign Application Priority Data

Apr. 24, 1985 [GB] United Kingdom ..... 8510450

[51] Int. Cl.[4] ..... C10L 1/22

[52] U.S. Cl. ..... 44/57; 44/62

[58] Field of Search ..... 44/57, 62

[56] References Cited

U.S. PATENT DOCUMENTS

| | | | |
|---|---|---|---|
| 3,502,451 | 3/1970 | Moore et al. | 44/62 |
| 3,753,670 | 8/1973 | Strang et al. | 44/72 |
| 4,357,148 | 11/1982 | Graiff | 44/62 |
| 4,575,382 | 3/1986 | Sweeney et al. | 44/57 |

*Primary Examiner*—Mrs. Y. Harris-Smith

[57] ABSTRACT

Diesel fuel composition comprising a hydrocarbonaceous diesel fuel having a cetane number in the range from 25 to 60, a polyolefin and a polyamine wherein at least one hydrocarbon chain has at least 25 carbon atoms and is bound directly to a nitrogen atom.

16 Claims, No Drawings

DIESEL FUEL COMPOSITION

SPECIFICATION

1. Field of the Invention

The present invention relates to a diesel fuel composition comprising a hydrocarbonaceous diesel fuel and additives which keep the injection system of a diesel engine clean.

In diesel engines good operation of the fuel injection system is of extreme importance. However, such injection systems are subject to build-up of deposits thereon, by which good performance of the engine is hampered, resulting e.g. in noisy running of the engine, excessive emission of smoke, hydrocarbons and carbon monoxide, and poor starting performance. Engine manufacturers design injectors to accommodate some deposit levels. Amounts beyond the expected levels lead to the above problems. Therefore, diesel fuels which do not form excessive deposits and/or which can remove deposits from the injectors would be very advantageous.

2. Background of the Invention

U.S. Pat. No. 3,502,451 discloses that polymers from low molecular weight olefins can suitably be used in gasoline for spark-ignited internal combustion engines. However, the referred to polymers are sensitive to high temperatures in the intake manifold of the engine and a portion of the polymer decomposes when subjected to high temperatures, tending to form deposits. Since in diesel engines the temperature of the injection system is substantially higher than the intake system temperature in spark-ignited engines, this type of polymers per se seems to be unsuitable for preventing deposits formation in diesel engines.

This is the more so, as diesel fuel is heavier than gasoline. The tendency of the formation of soot and other deposits during the combustion of diesel fuel is therefore greater than in the case of gasoline.

BRIEF DESCRIPTION OF THE INVENTION

It has now been determined that an additive comprising a polyolefin and a polyamine having at least one hydrocarbon chain possessing at least 25 carbon atoms bound directly to a nitrogen atom can be added to a diesel fuel composition having a cetane number in the range of 25 to 60 to keep an injection system for a diesel engine clean.

DETAILED DESCRIPTION OF THE INVENTION

The present invention therefore relates to a diesel fuel composition comprising a hydrocarbonaceous diesel fuel having a cetane number in the range from 25 to 60, a polyolefin and a polyamine wherein at least one hydrocarbon chain having at least 25 carbon atoms is bound directly to a nitrogen atom.

The hydrocarbonacous diesel fuel can be any fuel suitable for operating diesel engines, e.g. in road vehicles, ships and the like. Usually, the initial boiling point of such a fuel is at least 140° C. (at atmospheric pressure). The end boiling point generally is below 400° C. The invention is of particular advantage in hydrocarbon fuels boiling in the range from 150° to 390° C., especially from 175° to 370° C. Such fuels can be obtained directly from crude oil (straight-run), but also from a catalytically or thermally cracked product or a hydrotreated product. Mixtures of such products are also possible. If desired, the diesel fuel may comprise quality improvers.

The fuel composition of the present invention does not include gasoline. Gasoline and diesel fuel not only differ in distillation characteristics, as will be appreciated by a person reasonably skilled in the art, but they also differ in cetane number ranges. A typical cetane number range for gasoline is 10 to 20 while cetane values for diesel fuels range from 25 to 60.

The polyamines used in the composition according to the invention may be primary, secondary or tertiary amines. They can be aromatic or aliphatic. Suitable polyamine-moieties are ethylene diamine, diethylene triamine, trithylene tetramine, tetraethylene pentamine, propylene-or butylene diamine, or $\alpha$, $\omega$-diamines of alkylene groups containing 3 to 18 carbon atoms. Preferably, the polyamine is a diamine. In particular a polyamine is preferred which contains apart from the hydrocarbon chain(s) at least one organic group having from 1 to 10 carbon atoms bound to nitrogen.

Such an organic group can be bound to the same nitrogen atoms as the one to which a hydrocarbon chain having at least 25 carbon atoms is bound. The organic group can be any monovalent radical comprised of carbon and hydrogen moieties. It is also contemplated that minor amounts of oxygen or a halogen moiety may be present. Examples of suitable organic groups are straight or branched alkyl groups which may carry aromatic or cycloaliphatic hydrocarbon substituents. The organic groups having up to 10 carbon atoms are advantageously selected from alkyl groups with an unbranched carbon chain. Preference is given to substituted polyamines in which the organic group(s) has (have) less then 5 carbon atoms. The methyl moiety is a particularly preferred group.

Suitable substituted polyamine moieties that can be attached to a hydrocarbon chain with over 25 carbon atoms may be exemplified by diamine or preferably N,N-dimethyl-1,3-diamino propane.

The hydrocarbon chain having at least 25 carbon atoms present in the polyamine, preferably has at most 500 carbon atoms. The chain is advantageously a polymer constituted of recurrent olefinic units, such as ethylene, propylene, butylene, butadiene and the like. Generally such olefinic units contain 2 to 8 carbon atoms.

It is understood with the confines of this invention that, instead of ethylene or propylene, diolefin may be employed, which after polymerization and hydrogenation, yield a saturated polymer or copolymer of ethylene and/or propylene units. It is also possible to hydrogenate the product of the 1,4-polymerization of butadiene and to thereby obtain polyethylene. Hydrogenation of the product of the 1,4-polymerization of isoprene yields a copolymer of ethylene and propylene. Preferably, the hydrocarbon chain is constituted of $C_3$- and/or $C_4$-monoolefininc units. An especially preferred unit is isobutylene.

The polymer bound directly to a nitrogen atom of the polyamine has advantageously an average molecular weight ranging from 500 to 1500, corresponding with 35 to 105 carbon atoms. The most preferred polyamine is N-polyisobutylene-N',N'-dimethyl diamino propane, in which the polyisobutylene moiety has an average molecular weight ranging from 500 to 1500.

The polyolefin component of the composition according to the present invention can be a polymer as described in U.S. Pat. No. 3,502,451, which is herein incorporated by reference. Feasible polymers may be prepared from monoolefins or diolefins or copolymers of either. Polymers derived from diolefins are suitably hydrogenated. The average molecular weight is generally in the range from 500 to 3500, preferably from 550 to 1500. In the composition according to the present invention, the polyolefin polymers are preferably constituted of $C_3$- and/or $C_4$-monoolefins, with isobutylene being the preferred species.

The amount of the additives should be such that only acceptable amounts of deposit are built-up on the injection system of a diesel engine. Preferably, the amount of the polyamine is from 5 to 200 ppmw and the amount of the polyolefin is from 100 to 1200 ppmw, based on the total composition. The relative amounts of the polyamine and the polyolefin is preferably such that the weight ratio of the polyamine to the polyolefin ranges from 1:10 to 1:40.

The diesel fuel composition according to the invention is advantageously prepared by mixing a suitable amount of the polyamine and an amount of the polyolefin to the hydrocarbonaceous diesel fuel. This is most conveniently obtained by mixing a concentrate containing the polyamine and the polyolefin in suitable relative amounts in a carrier liquid, with the diesel fuel. Other compounds may be added to the concentrate such as a dehazer. The concentrate may contain from 0.01 to 0.2% w of a polyether type ethoxylated alkylphenol-formaldehyde resin. The carrier liquid must be compatible with diesel fuel. A suitable carrier liquid is xylene.

The diesel fuel composition according to the invention may further contain known additives, such as nitrates or nitrites, as a cetane improver or copolymers of ethylene and vinylesters, e.g. vinylacetate as a pour point depressant.

ILLUSTRATIVE EMBODIMENT

The invention will now be illustrated with reference to the following Illustrative Embodiments.

EXAMPLE I

A 1.6 1 turbocharged VW Golf diesel engine having four pintle-type injectors was subjected to 33 test cycles per experiment, each cycle comprising 20 sec. idle running, 5 min running at 1500 rpm and 30 min running at 3000 rpm. Subsequently, each injector was checked for deposit formation. This was attained by drawing air which was previously dried through the injector by a vacuum pump. A constant pressure drop across the injector of 0.6 bar was maintained. The needle in the injector was lifted 0.1 mm and the air-flow through the injector was determined.

For these experiments a diesel fluid having a cetane number of 43 was used with three additives. Additives I and II were N-polyisobutylene-N', N'-dimethyl-1,3-diamino propane, with the polyisobutylene chain in additive I having a molecular weight of 1350 and the polyisobutylene chain in additive II having a molecular weight of 900. Additive III was polyisobutylene with a molecular weight of 700. Conditions and results are presented in Table I.

TABLE I

| Experiment No. | Additive | Amount (ppme) | Mean air flow through injectors $cm^3$/min |
|---|---|---|---|
| 1 | — | — | 38 |
| 2 | I | 100 | 42 |
| 3 | II + III | 18 + 400 | 65 |

The mean air flow through the injectors before the test amounted to 265 $cm^3$/min. According to the engine manufacturer some deposits may be present on the injectors, since optimum performance at a needle-lift of 0.1 mm is achieved with air flows in the range from 50 to 120 $cm^3$/min.

From the above results it is apparent that such beneficial performance is only attained by using a fuel composition within the confines of this invention.

EXAMPLE II

At the end of the test cycles, described in Example I, the noise of the engine, running at 1500 rmp, was determined at 0.7 m from the engine front. Results are set forth in Table II.

TABLE II

| Experiment No. | Additive | amount (ppmw) | noise (dBA) |
|---|---|---|---|
| 1 | — | — | 89.5 |
| 2 | I | 100 | 90.0 |
| 3 | II + III | 18 + 400 | 85.8 |

The fuel compositions tested according to the instant invention yield the greatest reduction in engine noise.

What we claim as our invention is:

1. A diesel fuel composition comprising a hydrocarbonaceous diesel fuel having a cetane number in the range of from 25 to 60, a polyolefin comprised of $C_3$-, $C_4$-, or $C_3$-and $C_4$ olefins and a polyamine wherein at least one hydrocarbon chain has at least 25 carbon atoms bound directly to a nitrogen atom of said polyamine.

2. The diesel fuel composition of claim 1 wherein said polyamine is a diamine.

3. The diesel fuel composition of claim 1 wherein said polyamine has at least one hydrocarbon chain with at least 25 carbon atoms and at least one second organic group constituent having from 1 to 10 carbon atoms bound to said nitrogen compound.

4. The diesel fuel composition of claim 1 wherein said hydrocarbon chain having at least 25 carbon atoms is comprised of recurrent $C_3$-, $C_4$-, or $C_3$ and $C_4$-monoolefinic moieties.

5. The diesel fuel composition of claim 4 wherein said chain is comprised of recurrent isobutylene moieties.

6. The diesel fuel composition of claim 1 wherein the average molecular weight of the hydrocarbon chain ranges from 500 to 1500.

7. The diesel fuel composition of claim 1 wherein said polyamine is N-polyisobutylene-N',N'-dimethyl-1,3-diamimo propane.

8. The diesel fuel composition of claim 1 wherein said polyolefin is polyisobutylene.

9. The diesel fuel composition of claim 1 wherin said polyolefin has an average molecular weight ranging from 550 to 1500.

10. The diesel fuel composition of claim 1 wherein said polyamine is present, based on the total composition, in a quantity of from 5 to 200 ppmw and the amount of polyolefin is present, based on the total composition, in a quantity of from 100 to 1200 ppmw.

11. The diesel fuel composition of claim 1 wherein the weight ratio of polyamine to polyolefin ranges from 1:10 to 1:40.

12. The diesel fuel composition of claim 1 wherein said diesel fuel has a cetane value ranging from 25 to 60 and said polyolefin and polyamine comprise N-polyisobutylene-N'-N'-dimethyl-1,3-diamine propane with the polyisobutylene having a molecular weight of from 500 to 1500.

13. A diesel fuel composition comprising:

(a) a diesel fuel having an initial boiling point of from 140° C. and an end boiling point of 400° C. with a cetane value of from 25 to 60; and (b) an additive comprising a polyolefin comprised of $C_3$-, $C_4$- or $C_3$ and $C_4$ olefins and a polymine having at least one hydrocarbon chain bound directly to a nitrogen atom of said polyamine and having at least 25 carbon atoms.

14. The diesel fuel composition of claim 13 wherein said polyamine of said additive is present based on the total composition in an amount equal to 5 to 200 ppmw and said polyolefin of said additive is present based on the total composition in an amount of 100 to 1200 ppmw.

15. A diesel fuel composition comprising a diesel fuel having a cetane value of from 25 to 60 and an additive comprising N-polyisobutylene-N'-N'-dimethyl-1,3-diamino propane, said polyisobutylene having a molecular weight of from 500 to 1500.

16. The diesel fuel composition of claim 15 wherein said diesel fuel has a boiling point range of from 140° C. and 400° C.

* * * * *